US005944072A

United States Patent [19]

Tietz et al.

[11] Patent Number: 5,944,072

[45] Date of Patent: Aug. 31, 1999

[54] FILLING VALVE FOR CONTAINER FILLING MACHINE

[75] Inventors: Felix Tietz, Hamburg; Wolfgang Wilke, Hoisdorf, both of Germany

[73] Assignee: Crown Simplimatic Incorporated, Lynchburg, Va.

[21] Appl. No.: 09/032,299

[22] Filed: Feb. 27, 1998

[51] Int. Cl.[6] ..... B65B 43/42

[52] U.S. Cl. ..... 141/146; 222/168.5; 222/440; 222/444; 222/450; 141/147

[58] Field of Search ..... 141/144–147; 222/168.5, 438–440, 444, 448–453

[56] References Cited

U.S. PATENT DOCUMENTS

| | | | |
|---|---|---|---|
| 720,492 | 2/1903 | Sedberry | 222/309 |
| 931,649 | 8/1909 | Redington . | |
| 1,254,190 | 1/1918 | Baker | 141/141 |
| 2,028,266 | 1/1936 | Anderson . | |
| 2,141,618 | 12/1938 | Roge | 222/168.5 |
| 2,356,176 | 8/1944 | Pechy | 222/168.5 |
| 2,466,731 | 4/1949 | Nordquist | 222/168.5 |
| 2,600,391 | 6/1952 | Cabot | 222/168.5 |
| 2,761,605 | 9/1956 | Pahl et al. | 141/147 |
| 2,770,397 | 11/1956 | Galloway | 222/168.5 |
| 2,770,404 | 11/1956 | Galloway | 222/168.5 |
| 3,349,973 | 10/1967 | Smith | 222/168.5 |
| 3,850,345 | 11/1974 | Merritt | 222/168.5 |
| 5,150,743 | 9/1992 | Walusiak | 141/147 |

*Primary Examiner*—J. Casimer Jacyna
*Attorney, Agent, or Firm*—Howard & Howard

[57] ABSTRACT

A flange 52 extends upwardly about a filling passage 50 and a flexible tubular valve member 54 having a bead 56 in tension about and in sealing engagement with the flange and extending through an inlet cavity 48 to an annular ring 58 presenting an upwardly facing conical seat 60 for sealing engagement with a poppet valve 62. A helical spring 64 is disposed about the tubular valve member 54 and engages the annular ring 58 to urge the annular ring 58 into engagement with the periphery 46 of the valve seat in the filling position. A mast 66 is connected to the poppet valve 62 and extends upwardly through the chamber 34 for moving the mast 66 vertically between the chamber 34 charging position, as shown in FIG. 4, and the container 11 filling position, as shown in FIG. 5.

12 Claims, 5 Drawing Sheets

78
68
80
20
40
42
34
38
74
36
16
11

78
80
20
68
42
40
38
66
74
36
16
11

FILLING VALVE FOR CONTAINER FILLING MACHINE

BACKGROUND OF THE INVENTION

1. Field of the Invention

The subject invention relates to a high speed filling machine having a plurality of filling units for filling containers.

2. Description of the Prior Art

Filling machines in which containers are moved in a circle and filled from filling units are well known in the art. Included in the prior art are machines in which the filling units are filled, i.e., charged, with material, i.e., a beverage, from the bottom of the chamber. Such machines are illustrated in U.S. Pat. Nos. 720,492 to Sedberry; 1,254,190 to Baker; and 2,028,266 to Anderson.

SUMMARY OF THE INVENTION

A filling machine comprising a plurality of individual filling units and a common drive for moving the filling units through a plurality of actuator stations. Each of the filling units includes a working chamber having an interior wall. A container filling mechanism is disposed at the bottom of each chamber for filling an associated container and a supply of material fills the chamber. The machine is characterized by the container filling mechanism including a valve movable between a charging position for allowing material to flow from the supply into the working chamber while preventing flow into the container and a filling position for allowing the material form the chamber to fill the container while preventing flow from the supply into either one of the chamber and the container.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
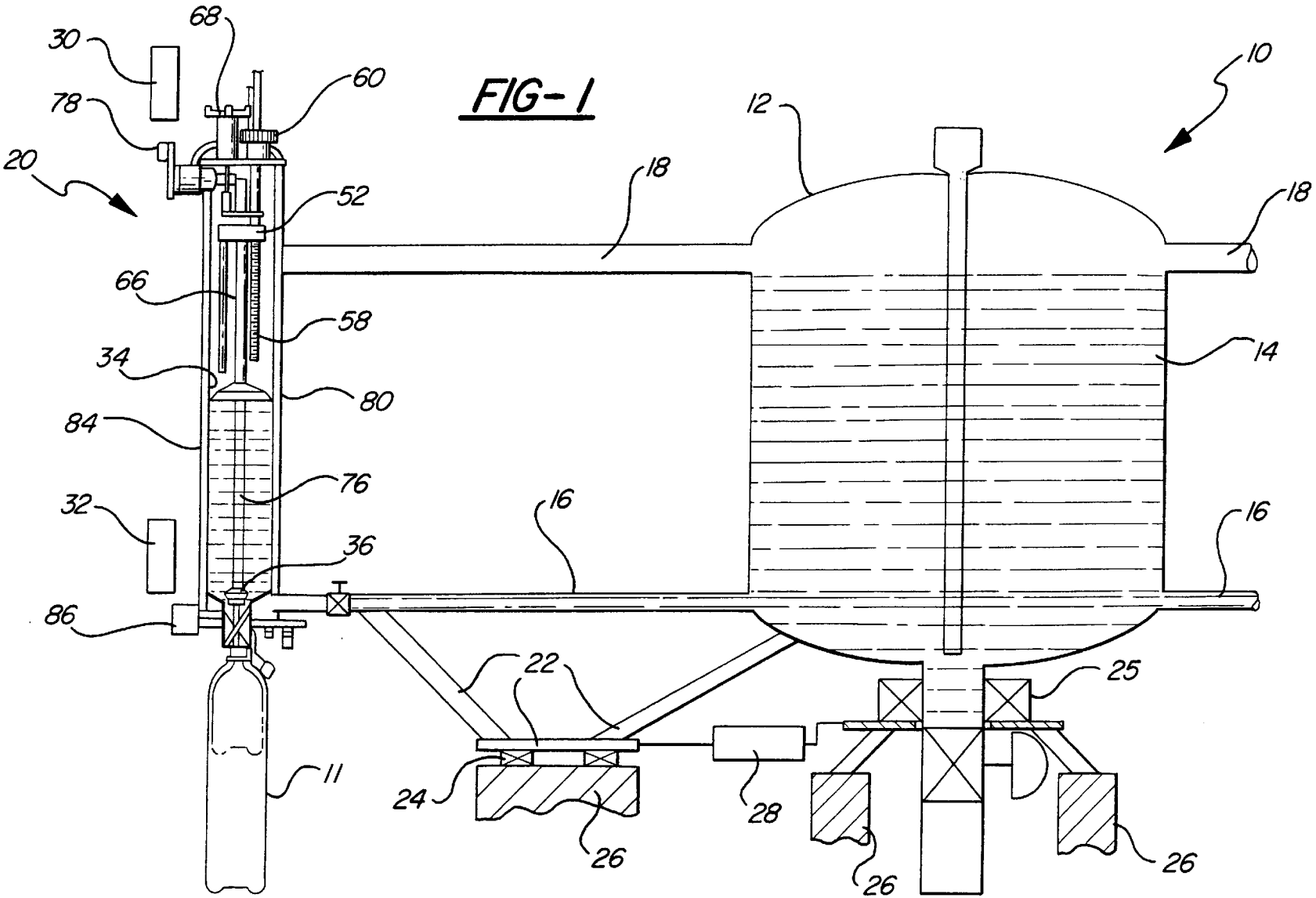
FIG. 1 is a schematic view showing one half of a circular filling machine employing the filling unit of the subject invention.
Figure 2:
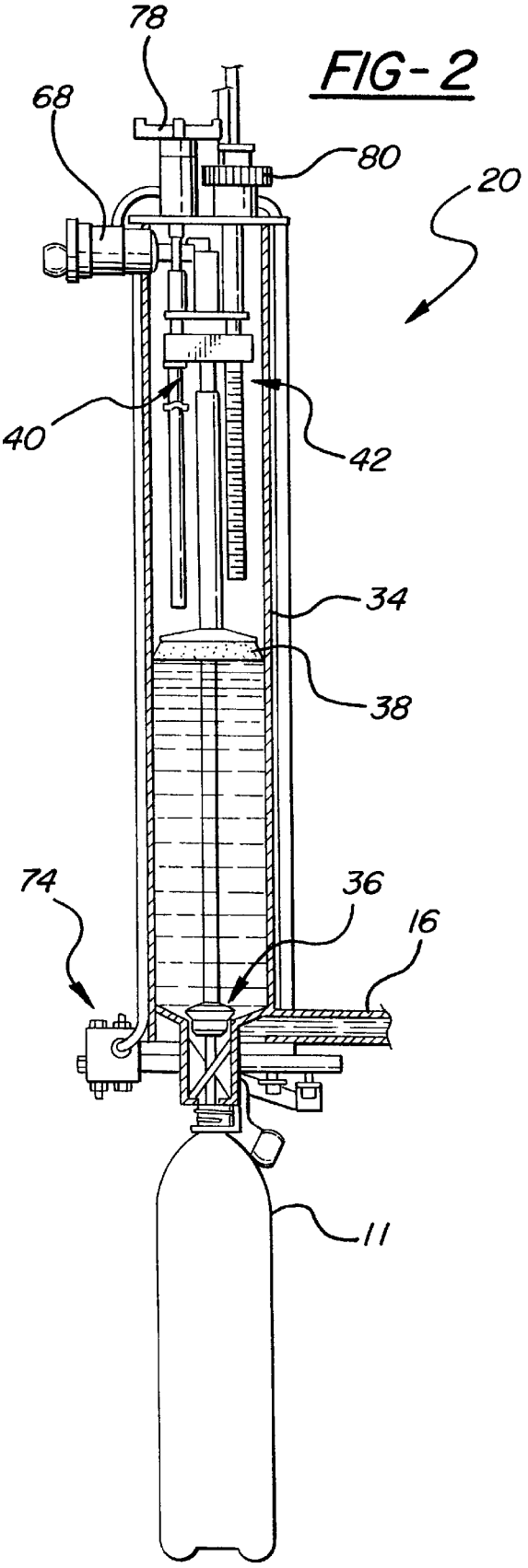
FIG. 2 is a cross sectional view of the filling unit of the subject invention with the chamber charged with material to fill a container.
Figure 3:
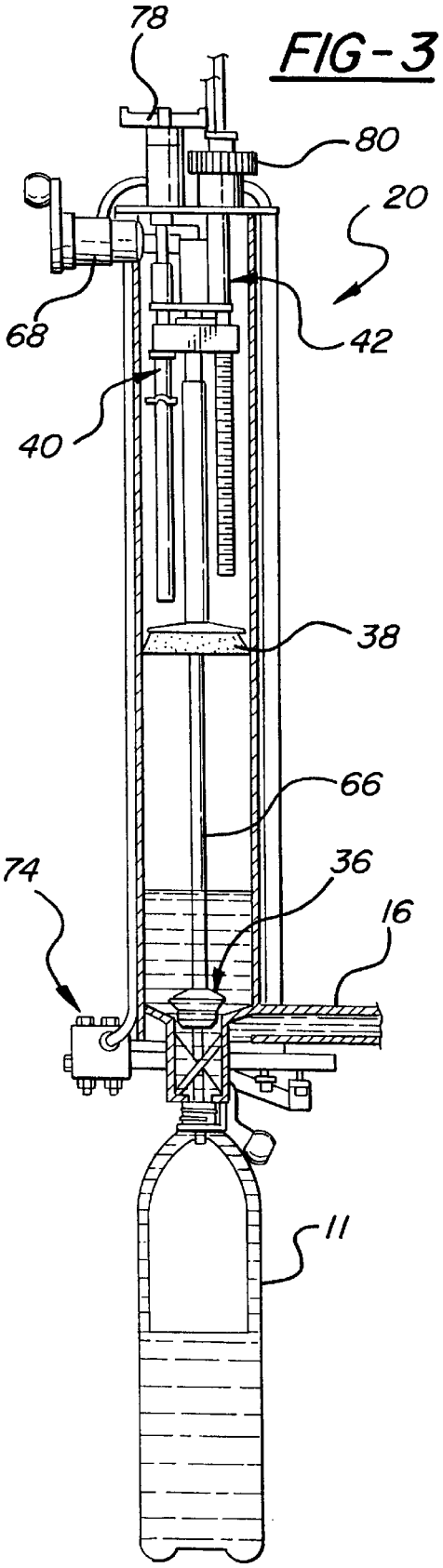
FIG. 3 is a view like FIG. 2 but showing the container being filled.

Referring to the Figures, wherein like numerals indicate like or corresponding parts throughout the several views, a filling machine is generally shown at 10 in FIG. 1 for filling containers, such as large bottles 11 or small bottles shown in phantom in FIG. 1. As is well known in the art, the filling machine is circular with a centrally disposed tank 12 for feeding material 14, in the form of a beverage, through feed lines 16 and return lines 18 extending radially like spokes from the tank 12 to a plurality of filling units, one of which is generally indicated at 20. The filling machine 10 is circular and is supported on a framework 22 which is, in turn, supported through bearing assemblies 24 on a foundation 26. In addition or alternatively, a center bearing 25 may support the tank 12 on the foundation 26. A common drive 28 is included for moving, i.e., rotating, the filling units 20 through a plurality of actuator stations, two of which are shown schematically at 30 and 32 in FIG. 1.

Each of the filling units 20 includes a working chamber 34 defined by an elongated cylinder having an interior wall and a container filling mechanism, generally indicated at 36, disposed at the bottom of each chamber 34 for controlling the flow of material 14 from the tank 12 and the fill line 16, which represent a supply of material for filling the chamber 34 with material through the filling mechanism 36.

An adjustment valve 38 determines the quantity of the material 14 to be filled into the chamber 34 by preventing the flow of material upwardly past the valve. A first actuator mechanism, generally indicated at 40, opens and closes the valve 38 and a second actuator mechanism, generally indicated at 42, adjusts the vertical position of the valve 38 to adjust the volume of material 14 for filling each container 11. The adjustment valve 38 determines the quantity of the material to be filled into the chamber 34 by preventing the flow of material upwardly past the valve and for allowing cleaning material 37 to flow downwardly past the valve.

The container filling mechanism 36 is characterized by including a multiple valve movable between a charging position for allowing material to flow from the supply 14 into the working chamber 34 while preventing flow into the container 11 and a filling position for allowing the material form the chamber 34 to fill the container 11 while preventing flow from the supply 14 into either one of the chamber 34 and the container 11.

The bottom of the chamber 34 is defined by a conical wall 44 slanted inwardly and downwardly from the interior wall of the chamber 34 to a circular and downwardly extending rim 46 defining an open periphery of a valve seat. The bottom of the chamber 34 therefore defines a valve seat having an open periphery 46 with an inlet cavity 48 below the bottom 44 and open to the supply of material 14. A filling passage 50 extends form the inlet cavity 48 for filling the container. A flange 52 extends upwardly about the filling passage 50. The multiple valve includes a tubular valve member 54 having a first end surrounding the filling passage 50 and extending through the inlet cavity 48 to a second end engaging the periphery 46 of the valve seat. More specifically, the first end of the tubular valve member 54 includes a bead 56 in tension about and in sealing engagement with the flange. The tubular valve member 54 is made of a flexible material, e.g., rubber or plastic. The second end of the tubular valve member 54 is defined by an annular ring 58 presenting an upwardly facing conical seat 60 for sealing engagement with a poppet valve 62. A biasing means, comprising a helical spring 64, is disposed about the tubular valve member 54 and engages the annular ring 58 to urge the annular ring 58 into engagement with the periphery 46 of the valve seat, i.e., the spring 64 biases the second end of the tubular valve member 54 into engagement with the periphery 46 of the valve seat in the filling position.

Figure 4:
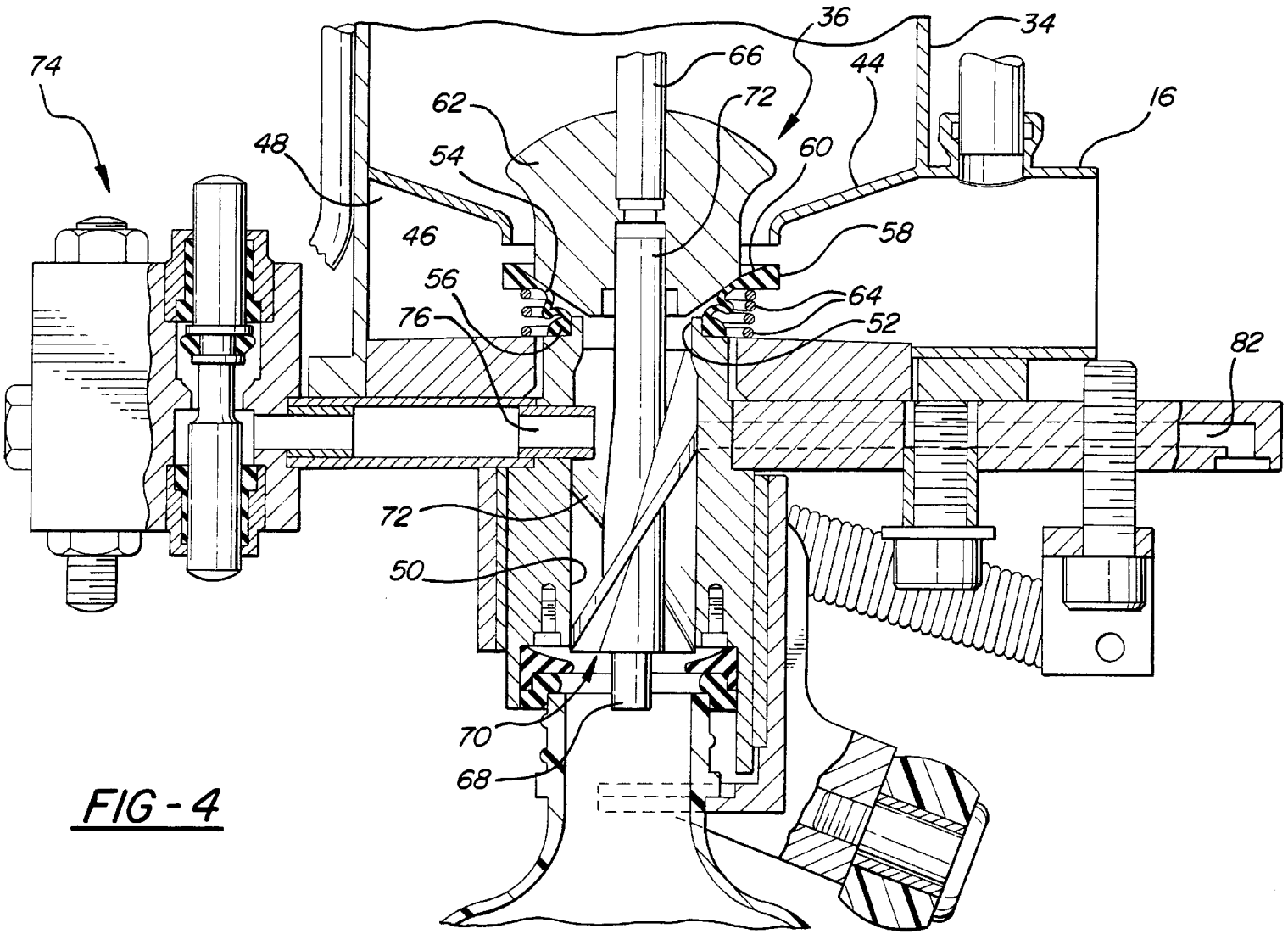
FIG. 4 is an enlarged fragmentary cross sectional view of the container filling mechanism of the subject invention in the charging position.
Figure 5:
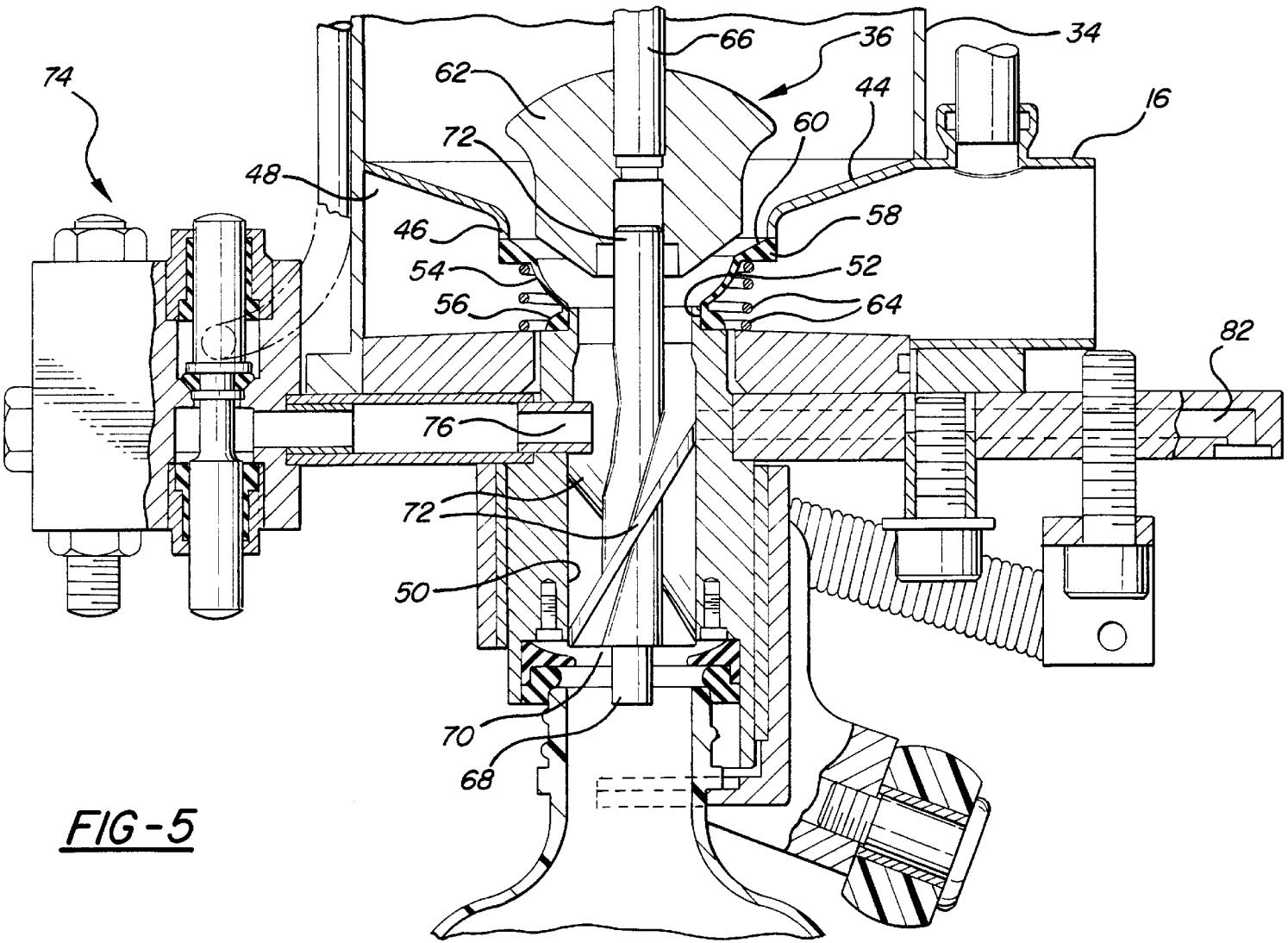
FIG. 5 is an enlarged fragmentary cross sectional view of the container filling mechanism of the subject invention but in the container filling position.
Figure 6:
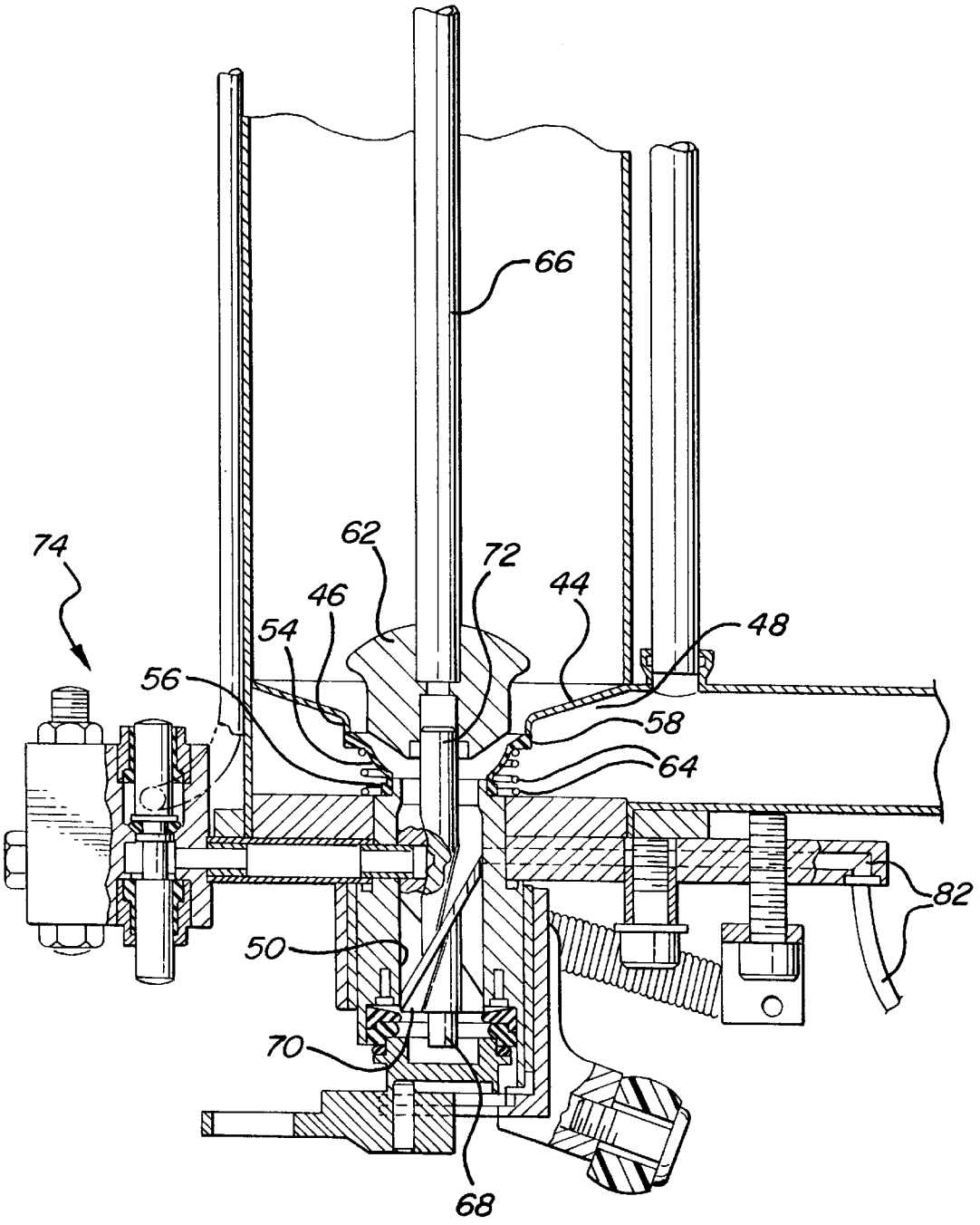
FIG. 6 is an enlarged fragmentary cross sectional view of the container filling mechanism of the subject invention but in the cleaning position.

A mast 66 is connected to the poppet valve 62 and extends upwardly through the chamber 34 to an upper end and an actuator 68 is supported by the chamber 34 and connected to the upper end of the mast 66 for moving the mast 66 vertically between the charging position, as shown in FIG. 4, and the filling position, as shown in FIG. 5. The actuator 68 is controlled by the actuator station 30 during rotation of the machine. The poppet valve 62 is connected to the mast by a force fit, glue, or the like. Accordingly, the poppet valve member 62 is connected to the mast 66 for movement from the filling position spaced above the tubular valve member (FIGS. 5 and 6) to sealing engagement with the conical valve seat 60 of the tubular valve member 54 to move the tubular valve member 54 vertically downward out of engagement with the periphery 46 of the valve seat to the charging position (FIG. 4) for charging the chamber 34 while preventing flow into the filling passage 50.

The mast 66 is a hollow tube and a vent tube 68 communicates with the hollow mast 66 and extends into the filling passage 50 for venting the container 11. A flow guide, generally indicated at 70, is disposed in the filling passage 50 for directing the flow of material to the sidewalls of the container 11 and the vent tube extending through the flow guide 70. More specifically, the flow guide 70 includes a center tube 72 which defines the upper end of the vent tube 68 which is in telescoping engagement with the poppet valve 62 to maintain a seal therebetween during movement of the poppet valve 62 between the charging position and the filling position.

The flow guide 70 includes guide vanes 72 filling the filling passage 50 around the vent tube section 72 to define a guide space. A counter pressure valve, generally shown at 74, is included for supplying a gas through a passage 76 to the guide space and into the container 11 prior to filling. The counter pressure valve 74 is controlled by the actuator station 32 during rotation of the machine.

The first actuator mechanism 40 is operated by a wheel 78 to open and close the valve 38 whereas the second actuator mechanism 42 is operated by a gear 80 to adjust the vertical position of the valve 38 to adjust the volume of material 14 for filling each container 11.

A cleaning passage 82 is included for releasing cleaning fluid from the chamber 34 between runs of different beverages.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A filling machine comprising:

a plurality of individual filling units (20);

a common drive (28) for moving said filling units (20) through a plurality of actuator stations (30 and 32), each of said filling units (20) including a working chamber (34) having an interior wall;

a container filling mechanism (36) at the bottom of each chamber (34) for filling an associated container (11);

a supply of material (14) for filling said chamber (34) with materials, said container filling mechanism (36) including a valve movable between a charging position for allowing material to flow from said supply (14) into said working chamber (34) while preventing flow into said container (11) and a filling position for allowing the material from said chamber (34) to fill said container (11) while preventing flow from said supply (14) into either one of said chamber (34) and said container (11);

said bottom (44) of said chamber (34) defining a valve scat having an open periphery (46), all inlet cavity disposed (48) below said bottom (44) and open to said supply of material (14), a filling passage (50) extending from said inlet cavity (48) for filling said container (11), said valve includes a tubular valve member (54) having a first end surrounding said filling passage (50) and extending through said inlet cavity (48) to a second end engaging said periphery (46) of said valve seat, and biasing means (64) biasing said second end of said tubular valve member (54) into engagement with said periphery (46) of said valve seat in said filling position.

2. An assembly as set forth in claim 1 including a mast (66) connected to said valve and extending upwardly through said chamber (34) to an upper end, an actuator (68) supported by said chamber (34) and connected to said upper end of said mast (66) for moving said mast (66) vertically between said charging position and said filling position.

3. An assembly as set forth in claim 2 wherein said valve includes a poppet valve (62) member connected to said mast (66) for movement from said filling position spaced above said tubular valve member (54) to sealing engagement with said tubular valve member (54) to move said tubular valve member (58) vertically downward out of engagement with said periphery (46) of said valve seat to said charging position for charging said chamber (34) while preventing flow into said filling passage (50).

4. An assembly as set forth in claim 3 wherein said mast (66) is hollow and including a vent tube (68) communicating with said hollow mast (66) and extending into said filling passage (50) for venting said container (11).

5. An assembly as set forth in claim 4 including a flow guide (70) disposed in said filling passage (50) for directing the flow of material to the sidewalls of the container (11), said vent tube (68) extending through said flow guide (70).

6. An assembly as set forth in claim 5 wherein said vent tube includes an upper end (72) in telescoping engagement with said poppet valve (62) to maintain a seal therebetween during movement of said poppet valve (62) between said charging position and said filling position.

7. An assembly as set forth in claim 6 wherein said flow guide (70) includes guide vanes (72) filling said filling passage (50) around said vent tube to define a guide space, and including a counter pressure valve (74) for supplying a gas to said guide space and into the container (11) prior to filling.

8. An assembly as set forth in claim 4 wherein said tubular valve member (54) is flexible and wherein said second end thereof is defined by an annular ring (58) presenting an upwardly facing conical seat (60) for sealing engagement with said poppet valve (62).

9. An assembly as set forth in claim 8 wherein said biasing means (64) comprises a helical spring disposed about said tubular valve member (54) and engaging said annular ring (58) to urge said annular ring (58) into engagement with said periphery (46) of said valve seat.

10. An assembly as set forth in claim 9 including a flange (52) extending upwardly about said filling passage (50) and said first end of said tubular valve member is disposed about and in sealing engagement with said flange (52).

11. An assembly as set forth in claim 10 wherein said first end of said tubular valve member (54) includes a bead (56) in tension about said flange (52).

12. An assembly as set forth in claim 11 wherein said bottom (44) of said chamber (34) is defined by a conical wall slanted inwardly and downwardly from said interior wall of said chamber (34) to a circular and downwardly extending rim defining said open periphery (46) of said valve seat.

* * * * *